US010907647B2

(12) United States Patent
Baryshnikov

(10) Patent No.: US 10,907,647 B2
(45) Date of Patent: Feb. 2, 2021

(54) CENTRIFUGAL PUMP WITH SERRATED IMPELLER

(71) Applicant: Dmitriy Baryshnikov, Rockford, IL (US)

(72) Inventor: Dmitriy Baryshnikov, Rockford, IL (US)

(73) Assignee: Woodward, Inc., Fort Collins, CO (US)

( * ) Notice: Subject to any disclaimer, the term of this patent is extended or adjusted under 35 U.S.C. 154(b) by 1422 days.

(21) Appl. No.: 14/833,936

(22) Filed: Aug. 24, 2015

(65) Prior Publication Data

US 2017/0058911 A1 Mar. 2, 2017

(51) Int. Cl.

| | |
|---|---|
| ***F04D 29/22*** | (2006.01) |
| ***F04D 1/00*** | (2006.01) |
| ***F04D 7/04*** | (2006.01) |
| ***F04D 29/043*** | (2006.01) |
| ***F04D 29/24*** | (2006.01) |
| ***F04D 29/42*** | (2006.01) |
| ***F04D 1/06*** | (2006.01) |

(52) U.S. Cl.

CPC ..... *F04D 29/2288* (2013.01); *F04D 1/00* (2013.01); *F04D 1/06* (2013.01); *F04D 7/045* (2013.01); *F04D 29/043* (2013.01); *F04D 29/2272* (2013.01); *F04D 29/24* (2013.01); *F04D 29/426* (2013.01)

(58) Field of Classification Search

CPC .... F04D 29/043; F04D 29/22; F04D 29/2211; F04D 29/2216; F04D 29/2238; F04D 29/2261; F04D 29/2272; F04D 29/2288; F04D 29/24; F04D 29/242; F04D 29/245; F04D 29/426; F04D 1/00; F04D 1/06; F04D 7/045; F05D 2250/182

See application file for complete search history.

(56) References Cited

U.S. PATENT DOCUMENTS

| | | | | | |
|---|---|---|---|---|---|
| 867,069 | A | * | 9/1907 | Neumann | F04D 29/30 416/186 R |
| 1,320,031 | A | * | 10/1919 | Andrews | F04D 29/662 416/144 |
| 2,625,365 | A | * | 1/1953 | Moore | F01D 5/043 228/182 |
| 2,658,455 | A | * | 11/1953 | Seinfeld | F04D 29/2211 415/106 |
| 2,941,780 | A | * | 6/1960 | Von Der Nuell | F01D 5/045 415/143 |

(Continued)

FOREIGN PATENT DOCUMENTS

| | | | |
|---|---|---|---|
| CN | 2 340 951 | Y | 9/1999 |
| CN | 103 244 456 | A | 8/2013 |

(Continued)

*Primary Examiner* — David E Sosnowski
*Assistant Examiner* — Wayne A Lambert
(74) *Attorney, Agent, or Firm* — Reinhart Boerner Van Deuren P.C.

(57) ABSTRACT

A centrifugal pump and an impeller thereof are provided. The impeller defines an outer peripheral edge which includes a plurality of serrations circumferentially thereon. The plurality of serrations are configured such that additional power and momentum are transferred to a working fluid of the pump, which results in an additional pressure rise in the working fluid at relatively low flow rates of the centrifugal pump.

19 Claims, 6 Drawing Sheets

(56) References Cited

U.S. PATENT DOCUMENTS 3,221,662 A * 12/1965 White ..... F04D 29/2261 415/1
3,283,829 A * 11/1966 Aumarechal ..... B63H 1/18 415/72
3,481,531 A * 12/1969 Macarthur ..... F04D 29/284 415/914
3,746,467 A 7/1973 Buse
3,915,394 A * 10/1975 Ferguson, Jr. ..... F04D 7/045 241/185.6
3,964,840 A * 6/1976 Kamelmacher ..... F04D 29/24 416/183
4,060,337 A * 11/1977 Bell, III ..... F04D 29/284 416/186 R
4,171,928 A * 10/1979 Emerson ..... F01D 3/00 415/104
4,767,277 A * 8/1988 Buse ..... F04D 29/20 416/241 A
4,890,980 A * 1/1990 Heald ..... F04D 29/2266 416/181
4,900,335 A * 2/1990 Algers ..... B01D 19/0052 55/408
5,106,263 A * 4/1992 Irie ..... F04D 29/2255 415/106
6,190,121 B1 * 2/2001 Hayward ..... F04D 7/045 415/121.1
6,210,116 B1 * 4/2001 Kuczaj ..... F04D 1/00 416/185
7,114,925 B2 * 10/2006 Shaw ..... F04D 29/2288 416/185
7,481,625 B2 * 1/2009 Kim ..... F01D 5/048 416/185
2002/0037215 A1 * 3/2002 Choi ..... F04D 17/12 415/104
2007/0280825 A1 * 12/2007 Chen ..... F04D 1/063 415/199.4

FOREIGN PATENT DOCUMENTS

GB 877878 9/1961
GB 877878 A * 9/1961 ..... F04D 9/02

* cited by examiner

CENTRIFUGAL PUMP WITH SERRATED IMPELLER

FIELD OF THE INVENTION

This invention generally relates to centrifugal pumps and their associated componentry, and more particularly to the impeller of a centrifugal pump.

BACKGROUND OF THE INVENTION

An impeller is a rotating component of a centrifugal pump which transfers energy from the power source that drives the pump to the fluid being pumped by accelerating the fluid outward from the center of rotation. The velocity of the impeller translates into pressure when the output movement is confined by the pump casing. Typically, an impeller includes a central hub or eye which is positioned at the pump inlet, and a plurality of vanes to propel the fluid radically. The central hub typically includes an axial bore or opening which may be splined to accept a splined driveshaft.

One of the challenges of centrifugal pumps is providing a generally constant pressure rise at the output of the pump across varying flow rates of the pump. This generally constant pressure rise is desirable for improving a dynamic stability of the system. Indeed, many contemporary high efficiency pumps, despite their high efficiency, have an appreciably lower pressure rise at low flow rates than at higher flow rates. To address this problem, a common solution is to use a less efficient centrifugal pump which does not exhibit as drastic of a pressure rise differential at low flow rates by increasing pump internal leakages. While such a solution has proven to be effective, it is not desirable in many cases, especially those applications where good thermal efficiency and low power consumption is a requirement.

Another approach to maintain a generally constant pressure rise across differing flow rates is to incorporate a stability valve into the system that effectively acts as a fixed orifice at any given flow. Unfortunately, this stability valve consumes extra power and reduces the pressure output of the pump. Further, with such a configuration, the overall size, weight, and cost of the system is increased.

Accordingly, there is a need in the art for a centrifugal pump which provides for a reduced amount of pressure rise variation across varying flow rates. The invention provides such a centrifugal pump. These and other advantages of the invention, as well as additional inventive features, will be apparent from the description of the invention provided herein.

BRIEF SUMMARY OF THE INVENTION

In one aspect, embodiments of the invention provide an impeller for a centrifugal pump. An impeller according to such an embodiment includes a disc-shaped shroud which has a central axis and a central hub circumscribing the central axis. The impeller also includes a disc shaped baseplate having a central axis coaxial with the central axis of the shroud. The baseplate has a plurality of vanes extending from a first surface of the baseplate. The shroud includes a plurality of serrations formed circumferentially along a periphery of the shroud. The baseplate includes a plurality of serrations formed circumferentially along a periphery of the baseplate. The shroud is mounted against the baseplate.

The central hub of the shroud has a first outer diameter. The baseplate includes a central hub extending axially from the first surface of the baseplate. The central hub of the baseplate has a second outer diameter which is less than the first outer diameter. A portion of the central hub of the baseplate extends axially into an opening defined by the central hub of the shroud.

The plurality of serrations of the baseplate includes a plurality of major teeth and a plurality of minor teeth arranged such that multiple minor teeth are arranged between adjacent ones of the plurality of major teeth. Each one of the plurality of major teeth has a thickness measured in the circumferential direction. Each one of the plurality of minor teeth has a thickness measured in the circumferential direction. The thickness of each of the plurality of major teeth is greater than the thickness of each of the plurality of minor teeth, respectively.

The plurality of vanes are aligned with the plurality of major teeth such that a radially outer facing surface of each vane is coplanar with a radially outer facing surface of each major tooth, respectively. A combined thickness of each one of the aligned plurality of vanes and plurality of major teeth measured circumferentially is variable in the axial direction.

The plurality of serrations of the shroud includes a plurality of major teeth and a plurality of minor teeth such that multiple minor teeth of the plurality of minor teeth are interposed between adjacent ones of the plurality of major teeth. The plurality of major teeth of the shroud are aligned with the plurality of major teeth of the baseplate. The plurality of minor teeth of the shroud are aligned with the plurality of minor teeth of the baseplate.

Each one of the plurality of serrations of the shroud has a first width measured axially and each one of the plurality of serrations of the baseplate has a second width measured axially. The first width is less than the second width.

In another aspect, embodiments of the invention provide an impeller for a centrifugal pump. An embodiment of a centrifugal pump according to this aspect includes a shroud and a baseplate. The shroud is mounted to the baseplate. A plurality of vanes are formed on the baseplate and are axially interposed between a portion of the baseplate and the shroud. The shroud and baseplate define an outer peripheral edge of the impeller. The outer peripheral edge includes a plurality of serrations formed circumferentially thereon.

Adjacent ones of the plurality of serrations are separated by gaps such that the plurality of serrations project radially outward. Each one of the plurality of serrations has a generally rectangular cross-sectional shape in the radial direction. The plurality of vanes project radially outward to the outer peripheral edge of the impeller. The plurality of serrations are formed by a plurality of serrations formed on the shroud and a plurality of serrations formed on the baseplate. The plurality of serrations on the shroud are aligned with the plurality of serrations on the baseplate.

In yet another aspect, embodiments of the invention provide a centrifugal pump. An embodiment of such a centrifugal pump includes a pump casing that defines an inlet, an outlet, and an internal cavity disposed between the inlet and the outlet. The pump also includes a drive shaft. A portion of the drive shaft is rotatably disposed within the internal cavity. The pump also includes an impeller disposed within the internal cavity. The impeller is mounted to the drive shaft such that it is rotatable with the drive shaft. The impeller is disc shaped and defines an outer peripheral edge. A plurality of serrations are formed on the outer peripheral edge.

The impeller also includes a shroud and a baseplate. The shroud is mounted to the baseplate. The plurality of serrations are formed on each of the shroud and the baseplate.

The impeller also includes a plurality of vanes formed on the baseplate. The plurality of vanes extend radially outward to the outer peripheral edge of the impeller such that the radial extents of the plurality of vanes are adjacent select ones of the plurality of serrations. The plurality of serrations have a generally rectangular cross-section in a radial direction.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Turning now to the drawings, an embodiment of a centrifugal pump and its associated serrated impeller according to the teachings of the present invention are illustrated. As will be explained in greater detail below, the serrated impeller overcomes problems with existing impeller designs by reducing the variance of pressure rise across differing flow rates. Indeed, the serrated impeller imparts additional momentum and velocity to a working fluid of the pump at low flow rates such that, even at such low flow rates, there is a satisfactory pressure increase in the working fluid. At higher flow rates, the velocity of the working fluid approaches that of the impeller itself, and as such, the serrated impeller has less of an impact on the pressure rise of the working fluid. As a result, the pump maintains a significantly "flatter" pressure rise characteristic of the working fluid across a broad spectrum of flow rates. As a result, the need for a stability valve as well as the need to utilize a less efficient pump is eliminated.

Figure 1:
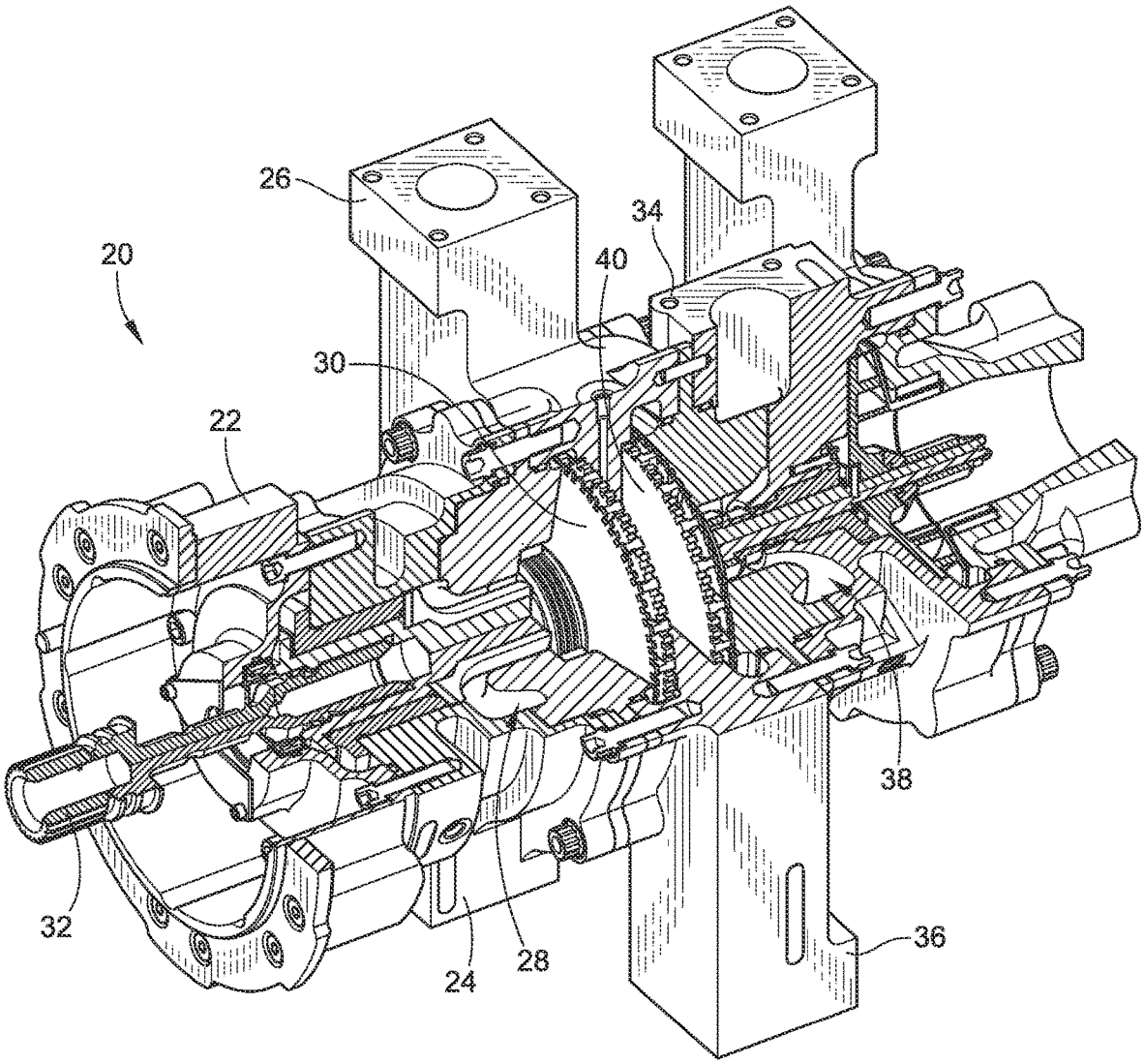
FIG. 1 is a perspective view of a partial cross section of an exemplary embodiment of a centrifugal pump with one or more serrated impellers according to the teachings of the present invention.

With particular reference to FIG. 1, a centrifugal pump 20 incorporating the aforementioned impeller is illustrated. More specifically, FIG. 1 illustrates a 3-stage centrifugal pump. Two of the stages employ serrated impellers according to the teachings of the present invention. While a 3-stage centrifugal pump is illustrated, it will be readily recognized that the advantages of the serrated impeller as described herein may be employed in other embodiments of centrifugal pumps, e.g. a single stage centrifugal pump.

Centrifugal pump 20 includes an outer casing 22. Centrifugal pump 20 also includes a number of inlets and outlets for each of its respective stages. Indeed, for one of the aforementioned stages, there is an inlet 24 and an outlet 26. An internal cavity 28 is defined between inlet 24 and outlet 26. A serrated impeller 30 is situated within internal cavity 28. Impeller 30 is utilized to pump or convey a working fluid from inlet 24 to outlet 26. In another one of the stages of centrifugal pump 20, there is another inlet 34 and outlet 36. Another internal cavity 38 is positioned between inlet 34 and outlet 36. A serrated impeller 40 is situated within internal cavity 38. This second serrated impeller 40 is identical to serrated impeller 30, except that it is a mirror image.

Figure 2:
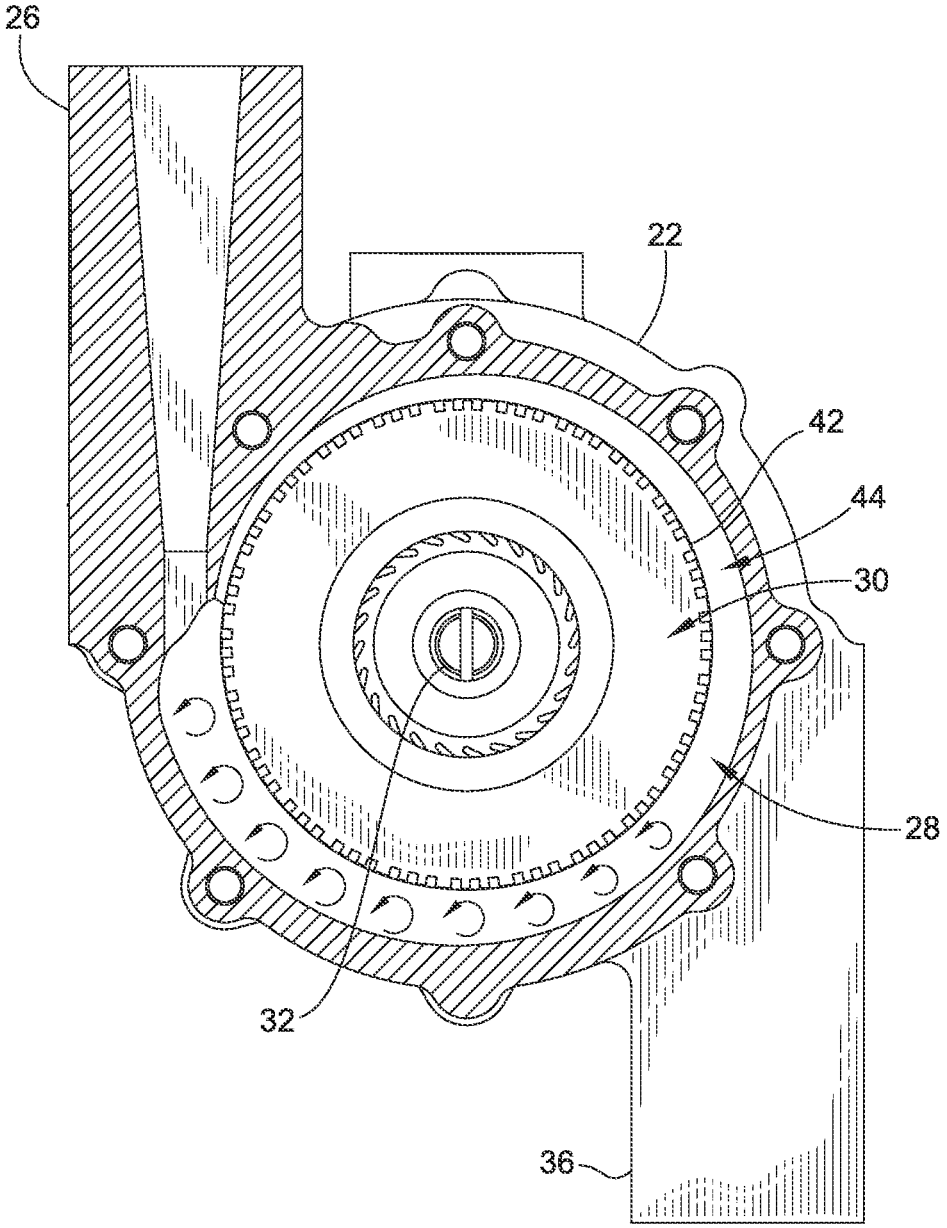
FIG. 2 is another cross section of the embodiment of FIG. 1.

Turning now to FIG. 2, a cross-section of centrifugal pump 20 is shown taken through the plane extending through outlet 26. This cross-section illustrates the relative positioning of impeller 30 within internal cavity 28. Impeller 30 is mounted on a shaft 32 (See also FIG. 1). Rotation of shaft 32 results in a like rotation of impeller 30. A peripheral edge 42 of impeller 30 includes a plurality of serrations 44 as shown.

In the particular configuration shown in FIG. 2, as impeller 30 rotates clockwise relative to a working fluid disposed within internal cavity 28, the plurality of serrations 44 impart extra momentum and power to the fluid causing the fluid to locally spin in a direction opposite to the rotation of impeller 30, i.e. counterclockwise. At low flow rates, this results an additional pressure rise. As a result, the relatively small pressure rise at low flows of existing designs is overcome by such a configuration.

As the flow rate is increased, the impeller circumferential velocity and the velocity of the working fluid within the internal cavity 28 approach one another. As a result, there is less momentum and power transfer to the working fluid from the plurality of serrations 44. Accordingly, the pressure rise of the working fluid at a low flow rate is closer to the pressure rise at a high flow rate than in non-serrated impeller designs. Therefore, the undesirable variance of pressure rise across varying flow rates is substantially reduced with such a configuration.

With reference now to FIGS. 3-7, the structural attributes of impeller 30 will be described in greater detail. As discussed above, but for being a mirror image, impeller 30 is identical to impeller 40 shown in FIG. 1. Therefore, the description provided for impeller 30 applies equally well to impeller 40 introduced above.

Figure 3:
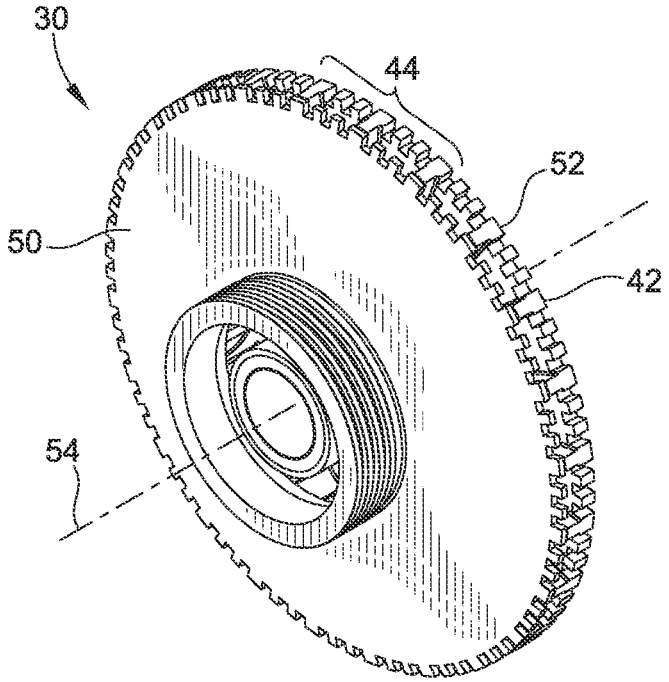
FIG. 3 is a perspective view of an exemplary embodiment of a serrated impeller according to the teachings of the present invention.

With particular reference to FIG. 3, impeller 30 includes a shroud 50 and a baseplate 52. Shroud 50 is mounted directly to baseplate 52. This mounting may be achieved by any mechanical connection. Shroud 50 and baseplate 52 are concentrically arranged about an axis 54 of impeller 30 passing through a center thereof. As can also be seen in FIG. 3, the plurality of serrations 44 extend radially outward and define the outer periphery of impeller 30. As will be understood from the following, both shroud 50 and baseplate 52 include their own serrations which are aligned with one another such that when fully assembled they form the aforementioned plurality of serrations of impeller 30. It will be recognized, however, that such an alignment is not necessary. In other embodiments, the plurality of serrations on shroud 50 may be misaligned with the plurality of serrations of baseplate 52.

Figure 4:
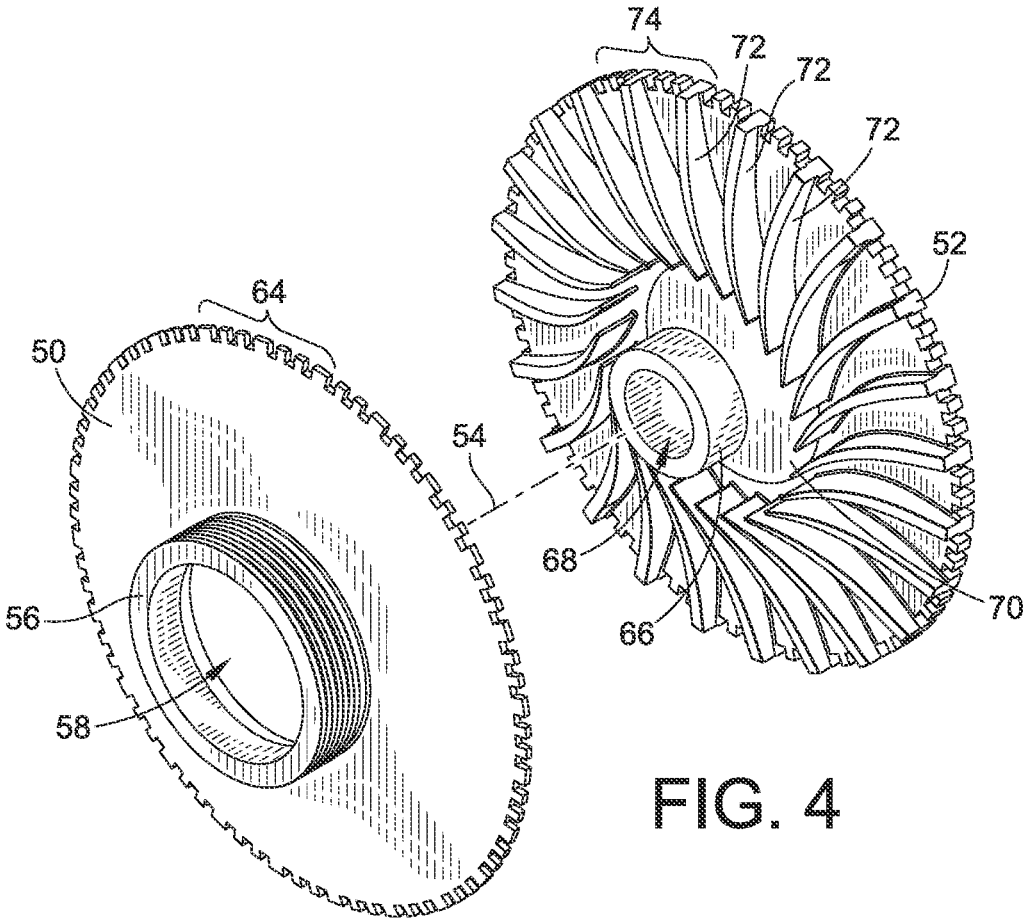
FIGS. 4 and 5 are perspective exploded views of the embodiment of the impeller of FIG. 3.

With reference now to FIG. 4, shroud 50 includes a central hub 56 defining a central opening 58. A plurality of serrations 64 define the outer periphery of shroud 50. This plurality of serrations 64 includes a number of major teeth 80 and minor teeth 82, as will be discussed in greater detail below.

Baseplate 52 also includes a central hub 66 with an opening 68 therethrough. Openings 58, 68 are sized such that shaft 32 (See FIG. 1) may extend therethrough. Additionally, opening 58 is also sized such that the working fluid flows from internal cavity 28 and subsequently contacts baseplate 52.

A plurality of vanes 72 extend axially outward from a first surface 70 of baseplate 52. As can be seen from inspection of FIG. 4, these vanes are arcuate in shape and extend from a diameter which is greater than an outer diameter of central hub 66 to an outer periphery of baseplate 52. In other embodiments, vanes 72 may extend radially inward such that they contact central hub 66. Also in other embodiments, vanes 72 may not extend radially to the outer periphery of impeller 30, but instead may stop short of this outer periphery.

As was the case with shroud 50, baseplate 52 also includes a plurality of serrations 74. As can also be seen in FIG. 4, each one of the plurality of vanes 72 includes a radially outer facing surface which is generally coplanar with a radially outer facing surface select ones of the plurality of serrations 74. As discussed in greater detail below, this plurality of serrations 74 includes a number of major teeth 90 and a number of minor teeth 92.

Figure 5:
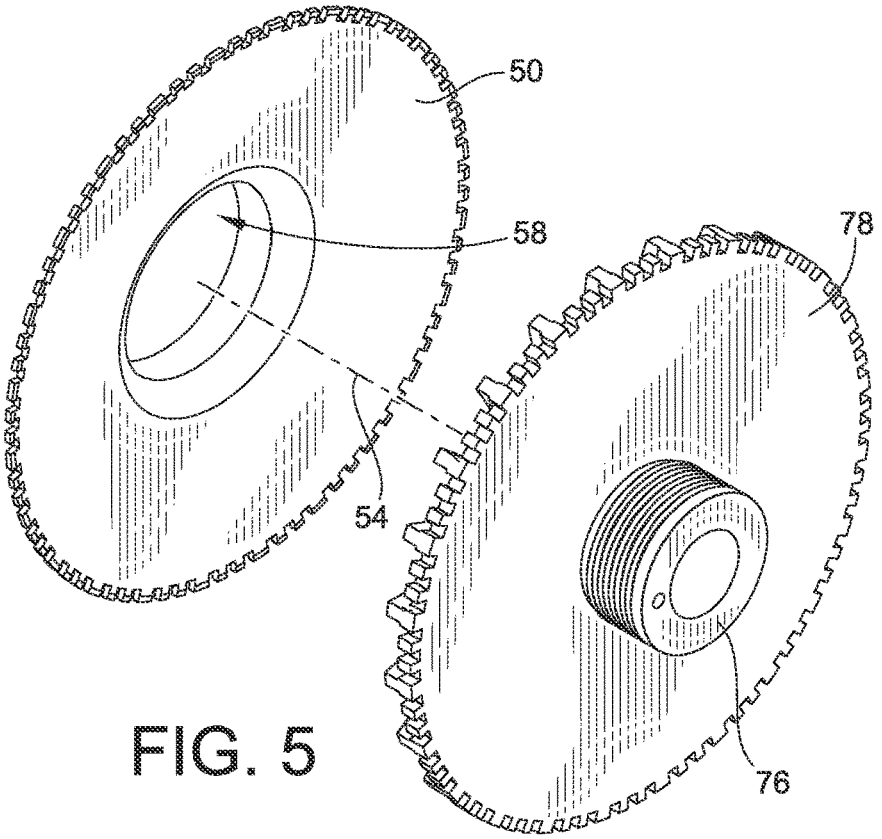

Turning now to FIG. 5, an additional hub 76 extends axially outward from a second surface 78 of baseplate 52 for the reception of shaft 32 (See FIG. 1). Although not shown, hub 56 as well as hub 76 may also include dynamic seals mounted thereon to sealingly engage an interior surface of pump casing 22.

Figure 6:
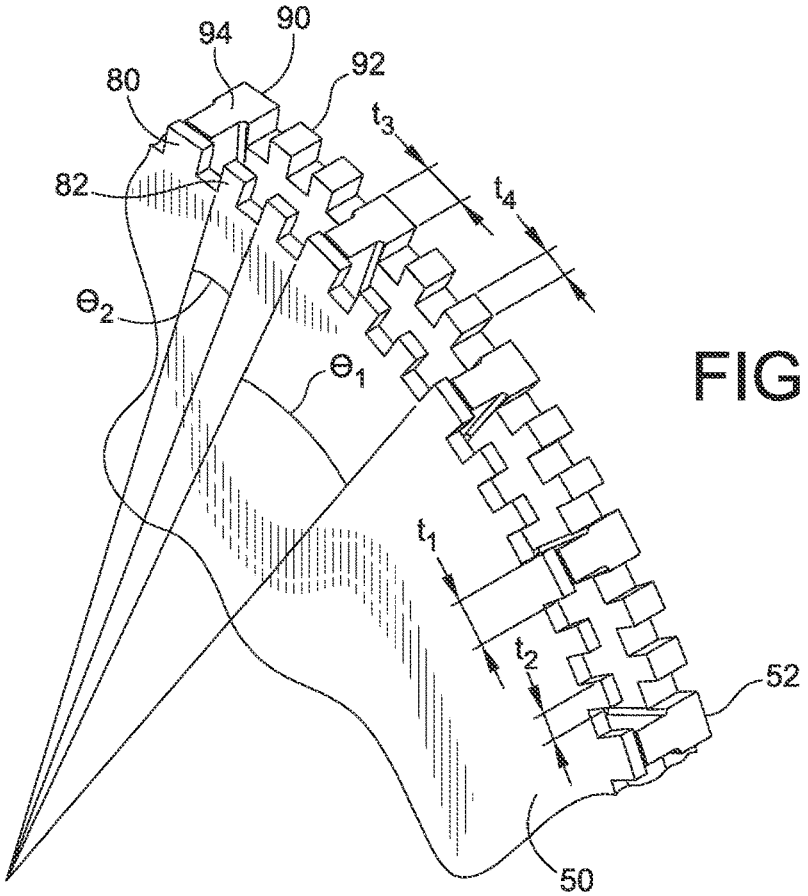
FIG. 6 is a partial perspective view of a peripheral edge of the embodiment of the impeller of FIG. 3.

With reference now to FIG. 6, the particular structural details of the aforementioned plurality of serrations will be discussed. Turning first to the plurality of serrations of shroud 50, the same includes a number of major teeth 80 and minor teeth 82. Major teeth 80 are distinguishable from minor teeth 82 in that they have a thickness $t_1$ measured in the circumferential direction which is greater than a thickness $t_2$ measured in the circumferential direction of minor teeth 82. As can also be seen in this view, major and minor teeth 80, 82 have a uniform width measured in the axial direction.

In a similar manner, the plurality of serrations of baseplate 52 include a number of major teeth 90 and minor teeth 92 as shown. Major and minor teeth 90, 92, are distinguishable in that a thickness $t_3$ measured in the circumferential direction of major teeth 90 is greater than a thickness $t_4$ measured in the circumferential direction of minor teeth 92. It will also be recognized from inspection of FIG. 6 that thickness $t_1$ is equal to thickness $t_3$ and thickness $t_2$ is equal to thickness $t_4$. As such, when the respective plurality of serrations of shroud 50 and baseplate 52 are aligned as shown they generally form a combined plurality of serrations with a number of major teeth and minor teeth. As described above, however, such an alignment is not necessary.

Another distinguishing factor between the major teeth 80, 90 and minor teeth 82, 92 is that between each major tooth 80, 90 an end of one of the aforementioned vanes 72 is disposed. As introduced above, each vane 72 includes a radially outer facing surface which is generally coplanar with a radially outer facing surface of each major tooth 90 on baseplate 52. The same holds true for each major tooth 80 of shroud 50. From inspection of FIG. 6, however, it will be recognized that the aforementioned radially outer facing surfaces of vanes 72 and major teeth 90 form a generally continuous and uninterrupted radially outer facing surface 94.

It will also be recognized from inspection of FIG. 6 that major teeth 80, 90 are annularly spaced apart at an angle $\theta_1$ which is greater than an angular spacing between $\theta_2$ between adjacent minor teeth 82, 92. In the particular configuration shown in FIG. 6, there are two minor teeth 82, 92 positioned between adjacent major teeth 80, 90. Further, the spacing or gaps formed between adjacent ones of major teeth 80 and minor teeth 82 as well as adjacent ones of minor teeth 82 is constant. The same holds true for major and minor teeth 90, 92 of baseplate 52. It will be recognized from the teachings herein that any number of teeth may be utilized. Further, it is also contemplated that rather than using major teeth and minor teeth of differing thicknesses taken in the circumferential direction, all teeth may have a uniform thickness.

Figure 7:
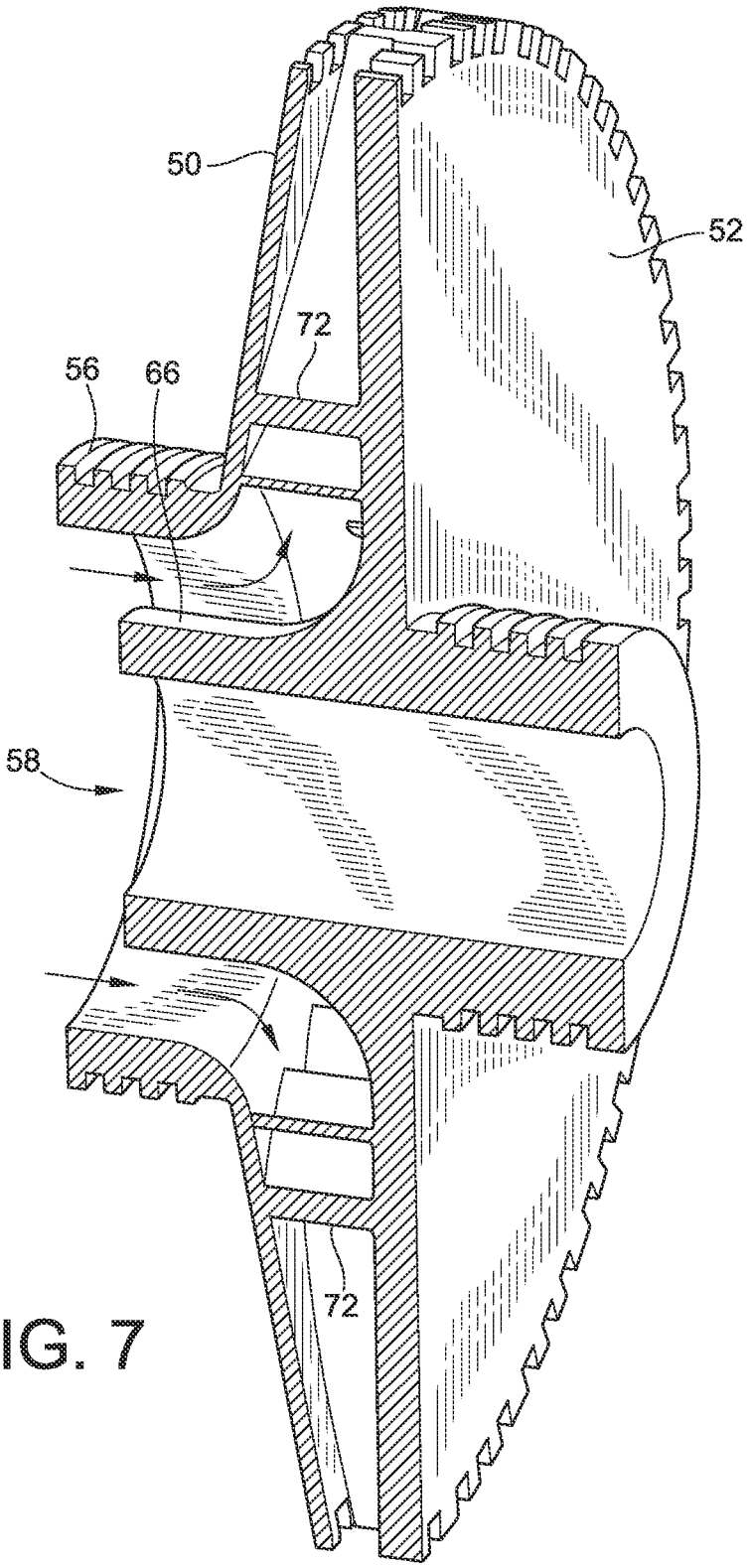
FIG. 7 is a perspective cross section of the embodiment of the impeller of FIG. 3.
Figure 8:
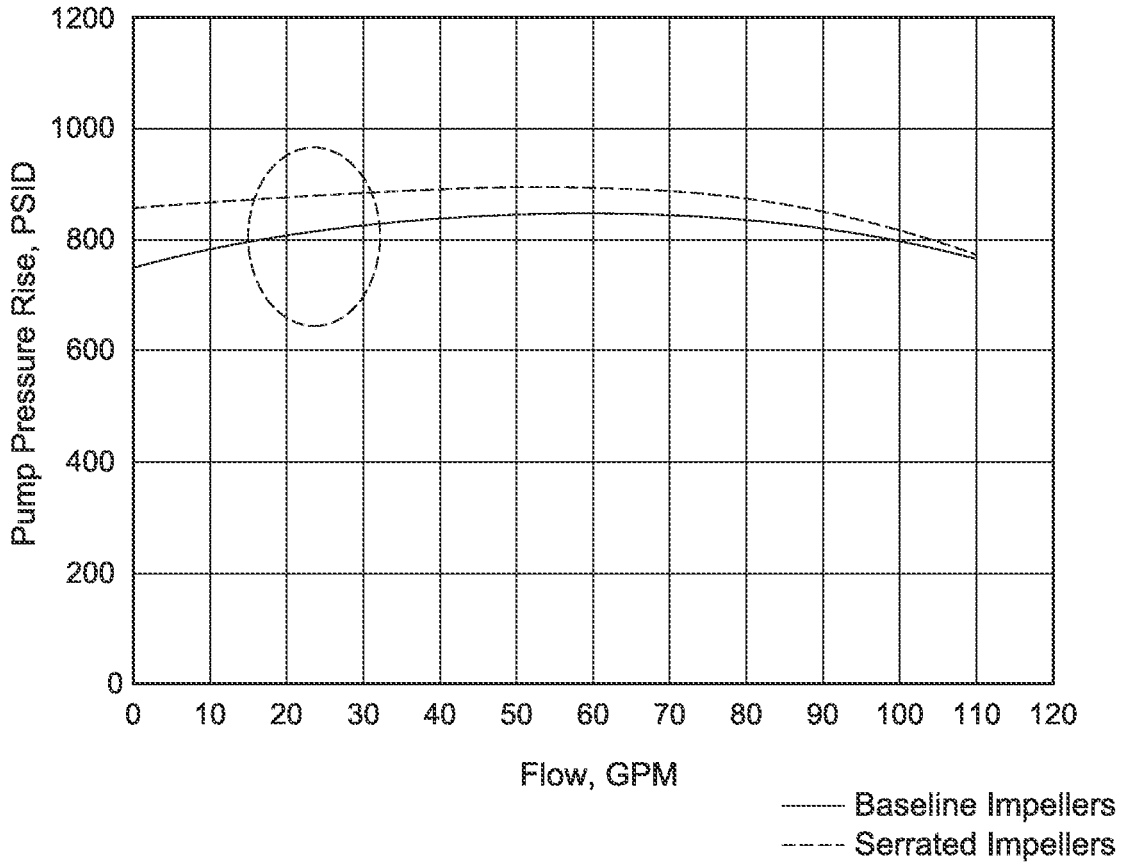
FIG. 8 is a graph illustrating the pressure rise as a function of flow rate for both a serrated impeller according to the invention and a non-serrated impeller.

Turning now to FIG. 7, a cross-section of impeller 30 is illustrated. The aforementioned concentric alignment of shroud 50 and baseplate 52 is shown. Hub 66 of baseplate 52 extends axially into opening 58 of hub 56 of shroud 50. Working fluid enters opening 58 as illustrated generally by flow directional arrows, and then encounters vanes 72 as it is propelled radially outward to the outer periphery of impeller 30.

As discussed above, the plurality of serrations of impeller 30 are configured to impart additional momentum and power to the working fluid at lower flow rates. Indeed, FIG. 9 illustrates a comparative example of a centrifugal pump employing a serrated impeller and a centrifugal pump which does not include a serrated impeller, i.e. a baseline impeller.

As can be seen from this graph, the difference in pump pressurize at a low flow rate of 10 gpm and a high flow rate of 50 gpm for a pump employing a serrated impeller is considerably less than a baseline impeller. As a result, the system produces a more desirable pressurize across low flow rates. This advantageously reduces or entirely eliminates the need to use a less efficient pump, or additionally or in the alternative, a stability valve to ensure that there is a sufficient pressurize at lower flow rates.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An impeller for a centrifugal pump, the impeller comprising:

a disc shaped shroud having a central axis, and a central hub circumscribing the central axis;

a disc shaped base plate having a central axis coaxial with the central axis of the shroud, the base plate having a plurality of vanes extending from a first surface of the base plate;

wherein the shroud includes a plurality of serrations formed circumferentially along a periphery of the shroud;

wherein the base plate includes a plurality of serrations formed circumferentially along a periphery of the base plate, the plurality of serrations of the base plate including a plurality of major teeth and a plurality of minor teeth, wherein a radial extent of each of the plurality of vanes is aligned with a respective one of the plurality of major teeth such that the respective one of the plurality of major teeth extends beyond both sides of the radial extent in the circumferential direction; and wherein the shroud is mounted against the base plate.

2. The impeller of claim 1, wherein the central hub of the shroud has a first outer diameter, and wherein the base plate includes a central hub extending axially from the first surface of the base plate, the central hub of the base plate having a second outer diameter which is less than the first outer diameter.

3. The impeller of claim 2, wherein a portion of the central hub of the base plate extends axially into an opening defined by the central hub of the shroud.

4. The impeller of claim 1, wherein the plurality of minor teeth are arranged such that multiple minor teeth are arranged between adjacent ones of the plurality of major teeth.

5. The impeller of claim 4, wherein each one of the plurality of major teeth has a thickness measured in the circumferential direction and wherein each one of the plurality of minor teeth has a thickness measured in the circumferential direction, wherein the thickness of each of the plurality of major teeth is greater than the thickness of each of the plurality of minor teeth, respectively.

6. The impeller of claim 4, wherein the plurality of vanes are aligned with the plurality of major teeth such that a radially outer facing surface of each vane is coplanar with a radially outer facing surface of each major tooth, respectively.

7. The impeller of claim 6, wherein a combined thickness of each one of the aligned plurality of vanes and plurality of major teeth measured circumferentially is variable in the axial direction.

8. The impeller of claim 4, wherein the plurality of serrations of the shroud includes a plurality major teeth and a plurality of minor teeth such that multiple minor teeth of the plurality of minor teeth are interposed between adjacent ones of the plurality of major teeth.

9. The impeller of claim 8 wherein the plurality of major teeth of the shroud are aligned with the plurality of major teeth of the base plate, and wherein the plurality of minor teeth of the shroud are aligned with the plurality of minor teeth of the base plate.

10. The impeller of claim 1, wherein each one of the plurality of serrations of the shroud has a first width measured axially and wherein each one of the plurality of serrations of the base plate has a second width measured axially, wherein the first width is less than the second width.

11. An impeller for a centrifugal pump, comprising:

a shroud;

a base plate, the shroud mounted to the base plate;

a plurality of vanes formed on the base plate and axially interposed between a base portion of the base plate and the shroud; and wherein the shroud and base plate define an outer peripheral edge of the impeller, wherein the outer peripheral edge includes a plurality of serrations formed circumferentially thereon, the plurality of serrations including a plurality of major teeth and a plurality of minor teeth, wherein a radial extent of each of the plurality of vanes is aligned with a respective one of the plurality of major teeth such that the respective one of the plurality of major teeth extends beyond both sides of the radial extent in the circumferential direction.

12. The impeller of claim 11, wherein adjacent ones of the plurality of serrations are separated by gaps such that the plurality of serrations project radially outward.

13. The impeller of claim 12, wherein each one of the plurality of serrations has a generally rectangular cross sectional shape in a radial direction.

14. The impeller of claim 11, wherein each of the plurality of vanes project radially outward to the outer peripheral edge of the impeller.

15. The impeller of claim 11, wherein the plurality of serrations are formed by a plurality of serrations formed on the shroud and a plurality of serrations on the base plate, wherein the plurality of serrations on the shroud are aligned with the plurality of serrations on the base plate.

16. A centrifugal pump, the centrifugal pump comprising:

a pump casing defining an inlet, and outlet, and an internal cavity disposed between the inlet and the outlet;

a drive shaft, a portion of the drive shaft rotatably disposed within the internal cavity;

an impeller disposed within the internal cavity, the impeller mounted to the drive shaft such that it is rotatable with said drive shaft;

wherein the impeller is disc shaped and defines an outer peripheral edge, wherein a plurality of serrations are formed on said outer peripheral edge, wherein the impeller further comprises a shroud and a base plate, the shroud mounted to the base plate, wherein the plurality of serrations are formed on each of the shroud and the base plate, wherein each one of the plurality of serrations of the shroud has a first width measured axially and wherein each one of the plurality of serrations of the base plate has a second width measured axially, wherein the first width is less than the second width.

17. The centrifugal pump of claim 16, wherein the impeller further comprises a plurality of vanes formed on the base plate.

18. The centrifugal pump of claim 17, wherein the plurality of vanes extend radially outward to the outer peripheral edge, such that radial extents of the plurality of vanes are adjacent select ones of the plurality of serrations.

19. The centrifugal pump of claim 18, wherein the plurality of serrations have a generally rectangular cross section in a radial direction.

* * * * *